US010774287B2

(12) United States Patent
Wu et al.

(10) Patent No.: US 10,774,287 B2
(45) Date of Patent: Sep. 15, 2020

(54) TRACTION FLUID COMPOSITION

(71) Applicant: VALVOLINE LICENSING AND INTELLECTUAL PROPERTY LLC, Lexington, KY (US)

(72) Inventors: Gefei Wu, Lexington, KY (US); Ning Ren, Naperville, IL (US); Frances E. Lockwood, Georgetown, KY (US)

(73) Assignee: VALVOLINE LICENSING AND INTELLECTUAL PROPERTY LLC, Lexington, KY (US)

( * ) Notice: Subject to any disclaimer, the term of this patent is extended or adjusted under 35 U.S.C. 154(b) by 0 days.

(21) Appl. No.: 16/293,884

(22) Filed: Mar. 6, 2019

(65) Prior Publication Data

US 2019/0276765 A1 Sep. 12, 2019

Related U.S. Application Data

(60) Provisional application No. 62/639,195, filed on Mar. 6, 2018.

(51) Int. Cl.

| | |
|---|---|
| ***C10M 169/04*** | (2006.01) |
| ***C10M 143/06*** | (2006.01) |
| ***C10M 145/14*** | (2006.01) |
| ***C10M 155/02*** | (2006.01) |
| ***C10M 139/04*** | (2006.01) |
| ***C10M 129/00*** | (2006.01) |
| ***C10M 141/12*** | (2006.01) |
| ***C10M 157/10*** | (2006.01) |
| ***C10M 105/06*** | (2006.01) |
| *C10N 30/02* | (2006.01) |
| *C10N 30/06* | (2006.01) |
| *C10N 30/18* | (2006.01) |
| *C10N 30/00* | (2006.01) |
| *C10N 40/04* | (2006.01) |

(52) U.S. Cl.

CPC ..... *C10M 169/044* (2013.01); *C10M 105/06* (2013.01); *C10M 129/00* (2013.01); *C10M 139/04* (2013.01); *C10M 141/12* (2013.01); *C10M 143/06* (2013.01); *C10M 145/14* (2013.01); *C10M 155/02* (2013.01); *C10M 157/10* (2013.01); *C10M 2203/065* (2013.01); *C10M 2205/026* (2013.01); *C10M 2205/028* (2013.01); *C10M 2207/28* (2013.01); *C10M 2209/084* (2013.01); *C10M 2227/04* (2013.01); *C10M 2229/02* (2013.01); *C10M 2229/04* (2013.01); *C10N 2030/02* (2013.01); *C10N 2030/06* (2013.01); *C10N 2030/18* (2013.01); *C10N 2030/68* (2020.05); *C10N 2040/045* (2020.05); *C10N 2040/046* (2020.05)

(58) Field of Classification Search

CPC ..... C10M 2209/084; C10M 2229/04; C10M 2205/02

See application file for complete search history.

(56) References Cited

U.S. PATENT DOCUMENTS

| | | | | |
|---|---|---|---|---|
| 2,530,774 | A | 11/1950 | Kehe et al. | |
| 3,646,235 | A | 2/1972 | Little et al. | |
| 3,677,970 | A | 7/1972 | Mertzweiller et al. | |
| 3,925,217 | A | 12/1975 | Green | |
| 3,975,278 | A | 8/1976 | Wygant | |
| 3,994,816 | A | 11/1976 | Wygant | |
| 4,199,481 | A | 4/1980 | Hall et al. | |
| 4,410,755 | A | 10/1983 | Fisher et al. | |
| 4,602,670 | A | 7/1986 | Laemmle et al. | |
| 4,830,767 | A | 5/1989 | Waynick | |
| 4,975,215 | A | 12/1990 | Abe | |
| 5,171,918 | A | 12/1992 | Shubkin | |
| 5,422,027 | A | 6/1995 | Abe et al. | |
| 5,602,086 | A | 2/1997 | Le et al. | |
| 5,627,147 | A | 5/1997 | Hayakawa et al. | |
| 5,973,206 | A | 10/1999 | Laitinen | |
| 6,001,780 | A | 12/1999 | Ho et al. | |
| 6,191,330 | B1 * | 2/2001 | Matsuno | C10M 105/04 252/73 |
| 6,239,085 | B1 | 5/2001 | Slack | |
| 6,242,393 | B1 * | 6/2001 | Ishida | C10M 105/00 252/73 |
| 6,372,696 | B1 | 4/2002 | Tipton | |

(Continued)

FOREIGN PATENT DOCUMENTS

| | | | |
|---|---|---|---|
| CN | 102964199 | B | 12/2014 |
| EP | 1967753 | A3 | 1/2010 |

(Continued)

OTHER PUBLICATIONS

International Search Report and Written Opinion issued in PCT application PCT/US2018/064710, dated Feb. 21, 2019.

(Continued)

*Primary Examiner* — Vishal V Vasisth

(74) *Attorney, Agent, or Firm* — Benesch, Friedlander, Coplan & Aronoff LLP

(57) ABSTRACT

Traction fluid additive combination that is usable with any traction fluids base stock is provided. To optimize the traction, low temperature viscosity and shear stability performance, a combination of a polyisobutene and a polymethacrylate may be added to a base oil to obtain a traction fluid with good low temperature viscosity without degrading the shear strength properties of the fluid. To minimize foaming of the traction fluid, a combination of one, two, or more anti-foaming agents may be added to the fluid in addition to a standard additive package.

11 Claims, No Drawings

(56) References Cited

U.S. PATENT DOCUMENTS

| | | | |
|---|---|---|---|
| 6,488,898 | B1 | 12/2002 | Lee et al. |
| 6,730,640 | B2 | 5/2004 | Sowerby et al. |
| 6,846,782 | B2 | 1/2005 | Calder |
| 6,858,767 | B1 | 2/2005 | Dimaio et al. |
| 7,045,055 | B2 | 5/2006 | Ziemer |
| 7,402,715 | B2 | 7/2008 | Yoshida |
| 7,425,524 | B2 | 9/2008 | Haire |
| 7,504,667 | B2 | 3/2009 | Fujikura |
| 7,576,044 | B2 | 8/2009 | Doner |
| 7,585,823 | B2 | 9/2009 | Sullivan et al. |
| 7,629,303 | B2 | 12/2009 | Hagemeister et al. |
| 7,651,985 | B2 | 1/2010 | Loh et al. |
| 7,662,271 | B2 | 2/2010 | Loh et al. |
| 7,732,389 | B2 | 6/2010 | Sullivan et al. |
| 7,732,391 | B1 | 6/2010 | Rosenbaum et al. |
| 7,973,001 | B2 | 7/2011 | Fujita et al. |
| 8,143,200 | B2 | 3/2012 | Vaughn et al. |
| 8,227,392 | B2 | 7/2012 | Wu et al. |
| 8,247,358 | B2 | 8/2012 | Lee |
| 8,252,735 | B2 | 8/2012 | Hagemeister |
| 8,399,390 | B2 | 3/2013 | Wu et al. |
| 8,476,205 | B2 | 7/2013 | Lee |
| 8,535,514 | B2 | 9/2013 | Carey et al. |
| 8,598,103 | B2 | 12/2013 | Carey et al. |
| 8,637,438 | B2 | 1/2014 | Yamada |
| 8,642,523 | B2 | 2/2014 | Crouthamel |
| 8,728,999 | B2 | 5/2014 | Carey et al. |
| 8,748,361 | B2 | 6/2014 | Wu et al. |
| 8,748,362 | B2 | 6/2014 | Tellier et al. |
| 8,759,267 | B2 | 6/2014 | Tellier et al. |
| 9,296,973 | B2 | 3/2016 | Fu |
| 9,365,797 | B2 | 6/2016 | Iwai |
| 9,458,403 | B2 | 10/2016 | Patil et al. |
| 9,528,074 | B2 | 12/2016 | Hogendoorn et al. |
| 9,617,495 | B2 | 4/2017 | Ghahary et al. |
| 9,708,561 | B2 | 7/2017 | Scherer et al. |
| 9,719,046 | B2 | 8/2017 | Beret et al. |
| 9,725,672 | B2 | 8/2017 | Fujita et al. |
| 2001/0010293 | A1* | 8/2001 | Ishida ..... C10M 105/04 208/19 |
| 2003/0207775 | A1 | 11/2003 | Sullivan et al. |
| 2004/0242441 | A1 | 12/2004 | Chiu |
| 2005/0121360 | A1 | 6/2005 | Lange |
| 2005/0148478 | A1 | 7/2005 | Ozbalik et al. |
| 2006/0196807 | A1 | 9/2006 | Rosenbaum |
| 2006/0264339 | A1 | 11/2006 | Devlin et al. |
| 2007/0087947 | A1 | 4/2007 | Glasgow et al. |
| 2008/0248983 | A1 | 10/2008 | Goyal |
| 2008/0274922 | A1 | 11/2008 | Yagishita |
| 2009/0088355 | A1 | 4/2009 | Hee |
| 2009/0298732 | A1 | 12/2009 | Hoste |
| 2011/0059877 | A1 | 3/2011 | Obiols et al. |
| 2012/0028857 | A1 | 2/2012 | Lee |
| 2013/0150626 | A1 | 6/2013 | Mertens |
| 2014/0113847 | A1 | 4/2014 | Givens |
| 2014/0221260 | A1 | 8/2014 | Herz |
| 2014/0350038 | A1 | 11/2014 | Reddy et al. |
| 2015/0353861 | A1 | 12/2015 | Lee |
| 2016/0230118 | A1 | 8/2016 | Taylor et al. |
| 2017/0044459 | A1 | 2/2017 | Goyal et al. |
| 2017/0183595 | A1 | 6/2017 | Ng et al. |
| 2017/0183596 | A1 | 6/2017 | Ng et al. |
| 2017/0183597 | A1 | 6/2017 | Ng et al. |

FOREIGN PATENT DOCUMENTS

| | | | |
|---|---|---|---|
| EP | 2937408 | B2 | 1/2017 |
| WO | 2011094562 | A1 | 8/2011 |
| WO | 2011094566 | A1 | 8/2011 |

OTHER PUBLICATIONS

B. Chaudhuri et al., Some Novel Aspects of the Dimerization of α-Methylstyrene with Acidic Ion-Exchange Resins, Clays and other Acidic Materials as Catalysts, Ind. Eng. Chem. Res., vol. 28, No. 12: 1989, pp. 1757-1763.

T. Tsubouchi, et al., Quantitative Correlation Between Molecular Structures of Traction Fluids and Their Traction Properties (Part 1): Influence of Alkylene Chain, Japanese Journal of Tribology, vol. 38, No. 3: 1993, pp. 403-410.

T. Tsubouchi, et al., Optimisation of Molecular Structure for Traction Fluids, Lubrication Scienc, ISSN 0954-0075: Aug. 2004, pp. 393-403.

International Search Report and Written Opinion in International Application No. PCT/US2019/020880, dated Jun. 13 2019 (10 pages).

* cited by examiner

TRACTION FLUID COMPOSITION

RELATED APPLICATIONS

This application claims priority to U.S. Provisional Patent Application No. 62/639,195 filed Mar. 6, 2018, herein incorporated by reference in its entirety.

FIELD OF INVENTION

This application relates generally to traction fluids.

BACKGROUND

Traction fluids rely on its high shear strength to provide torque transmission in devices like continuous variable transmission (CVT) or infinite variable transmission (IVT). Such transmission allows seamless integration with internal combustion engine for optimal engine performance and maximum fuel efficiency. In the year 1999, toroidal continuous variable transmission (T-CVT) cars were introduced in the market and the traction fluid used for the T-CVT required high level of performance in terms of high traction coefficient and low temperature fluidity of the molecule.

The shear strength can be measured as traction coefficient and it is the higher the better. Cycloaliphatic hydrocarbons usually possess superior shear strength property, but have poor low temperature viscosity properties. To balance these properties, fluids with good low temperature viscosity properties such as silicone, ester, or poly alpha olefin (PAO) can be incorporated into the practical traction fluids.

SUMMARY

Traction fluids comprising a base oil; a first viscosity additive; and a second viscosity additive, where the first viscosity additive minimizes degrading the traction coefficient of the traction fluid and second viscosity additive minimizes the increase of low temperature viscosity. The first viscosity additive may be a polyisobutene viscosity modifier and a second additive may be a polymethacrylate viscosity modifier The traction fluid may also comprise anti-foaming agents in an amount greater than about 0.01 (w/w) % and less than about 1 (w/w) %. The antifoaming agent may be present in an amount of about 0.1 (w/w) %. The anti-foaming agent may be a mixture of organic acid ester and siloxane or a silicone based fluid. The traction fluid may contain one, two or more anti-foaming agents.

The traction fluid may include additional additives such as an additive package including antioxidant agents, antiwear agents, extreme pressure agents, detergents, dispersants, antifoamer, anti-rust agents, friction modifiers, corrosion inhibitors, viscosity modifiers in an amount greater than about 0.01 (w/w) % and less than about 20 (w/w) % or in an amount of between about 3 (w/w) % and about 6 (w/w) %.

The traction fluid may be characterized by a Brookfield viscosity at −30° C. of below about 36,000 cP or below about 32,000 cP, The traction fluid should have a score of 10 mL, or lower in a foaming test, per ASTM test method D892.

The base stock may be present in an amount greater than about 80 (w/w) % and less than about 98 (w/w) % or in an amount between about 88 (w/w) % and less than about 92 (w/w) %.

The traction fluid may include additionally a poly alpha olefin, or an ester.

DETAILED DESCRIPTION

To optimize the high traction performance, this application introduces a combination of a polyisobutene and a polymethacrylate to a base oil to obtain a traction fluid with good low temperature viscosity without degrading the shear strength properties of the fluid. To minimize foaming in the traction fluid, a combination of one, two, or more anti-foaming agents may be added to the fluid in addition to a commercially available performance additive package.

Base Oils or Base Stock

The traction fluids described herein encompass any available fluids that are useable as base oils or base stocks for traction fluids. Hydrogenated alpha dimethyl styrene dimer or any other hydrogenated styrene dimer may be used as a stock. A siloxane, dimethylsilicone, poly alpha olefin, olefin, polyether, adamantine, or ester based fluid may also be used as a base stock to form traction fluids. Likewise, any hydrocarbon, naphthenic, a cycloaliphatic hydrocarbon, cyclic oligomer, bicycloheptane, or polycyclic hydrocarbon cyclic oligomer base stock will be considered a base stock for the traction fluids.

The traction fluids include at least about 80% base stock. Preferably the base stock is present in the traction fluid in an amount greater than about 83 (w/w) % and less than about 98 (w/w) % or in an amount between about 88 (w/w) % and less than about 92 (w/w) %.

Viscosity Modifiers

The traction fluids may contain a viscosity modifier or a combination of two viscosity modifiers including a first additive comprising a polyisobutene (PIB) and a second additive comprising a polymethacrylate (PMA).

The first viscosity additive comprising polyisobutene, such as, for example, the commercially available Lubrizol LZ 3174 has desirable traction performance and shear stability, but has less desirable low temperature viscosity. This first viscosity additive may be used alone in the traction fluid or in combination with another viscosity modifier.

The second viscosity additive comprising a polymethacrylate (PMA or combPMA) has desirable viscosity increasing effect at high temperatures while viscosity decreasing effect at low temperatures, but has less desirable traction performance and shear stability. This second additive may be added to the base stock alone or in combination with other viscosity modifiers. The polymethacrylate, such as, for example, the commercially available Evonik Viscoplex® 12-199.

The two viscosity modifiers may be added in any amounts depending on targeted viscosity. Preferably the total amount of the combination of viscosity modifiers between about 0.1 (w/w) % and about 10 (w/w) %, more preferably between about 0.1 (w/w) % and about 5 (w/w) %. The ratio of first viscosity modifier (polyisobutene) to second viscosity modifier (polymethacrylate) is between about 1:0.3 to about 1:1 and more preferably between about 1:0.6 and 1:0.7. Most preferably the first viscosity modifier is present in an amount about 1.5 to about 2.0 (w/w) % and the second viscosity modifier is present in an amount of about 0.1 to about 1.2 (w/w) %.

Additives

The traction fluids may also include at least one performance additive package. The performance additive package is generally a fully formulated composition, including antioxidant agents, antiwear agents, extreme pressure agents, detergents, dispersants, antifoamer, anti-rust agents, friction modifiers, corrosion inhibitors, and viscosity modifiers. The performance additive package may be commercially available, such as DI package, and used as directed by manufacturer. Additives such as a colorant or dye may also be added to the traction fluid.

Antifoamers

In addition to any defoamer or antifoamer that may be present in the additive package, at least one additional antifoamer may be added to the traction fluid. Preferably, at least two antifoamers are added to the traction fluid. More than two antifoamers may also be added to the traction fluid. The traction fluid may include an anti-foaming agent that is an organic acid ester, a siloxane, a silicone based fluid or a combination of any of these compounds. One antifoamer, may include a mixture of compounds such as an organic acid ester and siloxane, such as, for example, the commercially available Nalco 2301. One antifoamer may be silicone based, such as for example the commercially available Chemaloy F-655.

The traction fluid may include the anti-foaming agent in an amount greater than about 0.01 (w/w) % and less than about 1 (w/w) %. The anti-foaming agent maybe present in an amount of about 0.1 (w/w) %.

The traction fluid comprising a base stock, a first and second viscosity modifier, an additive package and at least two antifoamers should also have a Brookfield viscosity at −30° C. below 32,000 cP, and a score of 10 mL or lower in a foaming test per ASTM test method D892.

EXAMPLES

Certain embodiments are described below in the form of examples. While the embodiments are described in considerable detail, it is not the intention to restrict or in any way limit the scope of the appended claims to such detail, or to any particular embodiment.

Example 1: Comparison of Traction Fluid Additives

A series of traction fluids having a base stock of hydrogenated alpha dimethyl styrene dimer (HAD) containing additives such as, polyalphaolefin (PAO), polyisobutene, polymethacrylate (PMA), antifoamers and a performance additive package are compared in Table 1.

TABLE 1

A summary of traction fluid formulations and properties

| code | A | B | C | D | E |
|---|---|---|---|---|---|
| Hydro ASM Dimer | 83.2 | 88 | 92.2 | 91.6 | 90.8 |
| PAO 2 cSt | 8 | 3 | | | |
| Performance Additive Package | 5.7 | 5.7 | 5.7 | 5.7 | 5.7 |
| Viscosity Modifier 1 (PIB) | | 2 | | 1.5 | 3.4 |
| Viscosity Modifier 2 (comb PMA) | 3 | 1.2 | 2 | 1.1 | |
| anti-foaming 1 | 0.05 | 0.05 | 0.05 | 0.05 | 0.05 |
| anti-foaming 2 | 0.05 | 0.05 | 0.05 | 0.05 | 0.05 |
| Total | 100 | 100 | 100 | 100 | 100 |
| kv 100C( cSt) | 4.74 | 4.74 | 4.77 | 4.77 | 4.77 |
| BF-30C (cP) | 9,600 | 20,850 | 27,050 | 31,000 | 37,200 |
| Viscosity Shear loss (%) (100° C. for 40 hrs) | 4.65 | 2.85 | 4.35 | 2.52 | 0.36 |

TABLE 1-continued

A summary of traction fluid formulations and properties

| code | A | B | C | D | E |
|---|---|---|---|---|---|
| Foaming I/II/III (ASTM D 892) | 0/30/0 | 0/10/0 | 0/10/0 | 0/5/0 | 0/5/0 |
| Traction coefficient | 0.0821 | 0.0898 | 0.0938 | 0.0942 | 0.945 |

Five traction fluids with hydrogenated alpha dimethyl styrene dimer (HAD) as a base oil were studied with differing viscosity modifiers, antifoamers and additives. The additives poly alpha olefin (PAO), polyisobutene (PIB), or polymethacrylate (combPMA) were tested alone or in combination. KV 100C was targeted at 4.7 cST.

The Table 1 demonstrates that for a traction fluid to have a Brook Field viscosity at −30° C. below 32,000 cP while keeping higher traction coefficient and less viscosity shear loss, it requires a combination of a first polyisobutene viscosity modifier and a second polymethacrylate viscosity modifier (fluid D) See particularly fluids "C", "D" and "E". If only the first polyisobutene viscosity modifier is used (fluid E), the Brookfield viscosity at −30° C. exceeds 32,000 cP. If only the second polymethacrylate viscosity modifier is used (Fluid C), the viscosity shear loss and traction coefficient would have to be compromised. Adding poly alpha olefin or ester into the formulation can lower Brookfield viscosity, but the traction coefficient would be comprised significantly (fluids A and B). As can be seen from the final row of Table 1, the addition of two anti-foaming agents, together with the first polyisobutene viscosity modifier and a second polymethacrylate viscosity modifier improved the performance of the traction fluid in foaming tests.

To the extent that the term "includes" or "including" is used in the specification or the claims, it is intended to be inclusive in a manner similar to the term "comprising" as that term is interpreted when employed as a transitional word in a claim. Furthermore, to the extent that the term "or" is employed (e.g., A or B) it is intended to mean "A or B or both." When "only A or B but not both" is intended, then the term "only A Or B but not both" will be employed. Thus, use of the term "or" herein is the inclusive, and not the exclusive use. As used in the specification and the claims, the singular forms "a," "an," and "the" include the plural. Finally where the term "about" is used in conjunction with a number, it is intended to include ±10% of the number. For example, "about 10" may mean from 9 to 11. The term wt % is meant to describe a comparison of the weight of one compound to the weight of the whole composition expressed as a percent. It can also be described as wt. %, or (w/w) %. The term defoamer is equivalent to antifoamer, anti-foamer, or defoamer and includes any substance that reduces or hinders the formation of foam in a traction fluid. The terms base oil and base stock are interchangeable and refer to a fluid that is present in an amount greater than about 70% and forms the basis of a traction fluid.

As stated above, while the present application has been illustrated by the description of embodiments, and while the embodiments have been described in considerable detail, it is not the intention to restrict or in any way limit the scope of the appended claims to such detail. Additional advantages and modifications will readily appear to those skilled in the art, having the benefit of this application. Therefore, the application, in its broader aspects, is not limited to the specific details and illustrative examples shown. Departures may be made from such details and examples without departing from the spirit or scope of the general inventive concept.

The invention claimed is:

1. A traction fluid comprising:

a base oil comprising hydrogenated alpha dimethyl styrene dimer;

a first viscosity additive comprising a polyisobutene in an amount greater than about 0.1 (w/w) % and less than about 10 (w/w) %; and a second viscosity additive comprising a comb-polymethacrylate in an amount greater than about 1.0 (w/w) % and less than about 3 (w/w) %, wherein the traction fluid is characterized by 1) a Brookfield viscosity at −30 C of between 31,000 and about 36,000 cP and 2) a traction coefficient equal to or greater than 0.0942 or a shear loss of between 2.52% and 4.65% in a shearing loss test or both.

2. The traction fluid of claim 1, further comprising at least one anti-foaming agent.

3. The traction fluid of claim 2, the anti-foaming agent present in an amount greater than about 0.01 (w/w) % and less than about 10 (w/w) %.

4. The traction fluid of claim 3, the anti-foaming agent present in an amount of about 0.1 (w/w) %.

5. The traction fluid of claim 3, the anti-foaming agent selected from the group consisting of: a mixture of organic acid ester and siloxane or a silicone based fluid.

6. The traction fluid of claim 1, further comprising at least one additional additive.

7. The traction fluid of claim 6, the at least one additional additive present in an amount greater than about 0.01 (w/w) % and less than about 20 (w/w) %.

8. The traction fluid of claim 7, the at least one additional additive present in an amount of between about 3 (w/w) % and about 6 (w/w) %.

9. The traction fluid of claim 1, the first viscosity additive present in an amount greater than about 4.0 (w/w) % and less than about 5 (w/w) %.

10. The traction fluid of claim 1, the first and second viscosity additives are present in a ratio of first viscosity additive:second viscosity additive between about 1:0.6 to about 1:0.7.

11. A traction fluid comprising:

a base oil comprising hydrogenated alpha dimethyl styrene dimer;

a first viscosity additive comprising a polyisobutene in an amount greater than about 0.1 (w/w) % and less than about 10 (w/w) %; and a second viscosity additive comprising a comb-polymethacrylate in an amount greater than about 1.0 (w/w) % and less than about 3 (w/w) %, wherein the traction fluid is characterized by 1) a Brookfield viscosity at −30 C of between 20,850 and about 32,000 cP and 2) a traction coefficient equal to or greater than 0.0898 or a shear loss of between 2.52% and 4.65% in a shearing loss test or both.

* * * * *